US005692564A

United States Patent [19]

Brooks

[11] Patent Number: 5,692,564

[45] Date of Patent: Dec. 2, 1997

[54] HORIZONTAL INFLATION TOOL SELECTIVE MANDREL LOCKING DEVICE

[75] Inventor: Robert T. Brooks, Corpus Christi, Tex.

[73] Assignee: Baker Hughes Incorporated, Houston, Tex.

[21] Appl. No.: 552,530

[22] Filed: Nov. 6, 1995

[51] Int. Cl.[6] ..... E21B 33/124; E21B 33/128

[52] U.S. Cl. ..... 166/127; 166/136; 166/185; 166/191

[58] Field of Search ..... 166/127, 136, 166/185, 186, 191, 196

[56] References Cited

U.S. PATENT DOCUMENTS

| | | | |
|---|---|---|---|
| 4,522,259 | 6/1985 | Akkerman | 166/237 |
| 4,567,944 | 2/1986 | Zunkel et al. | 166/120 |
| 4,605,064 | 8/1986 | Akkerman | 166/237 |
| 4,628,998 | 12/1986 | Akkerman | 166/237 |
| 4,640,351 | 2/1987 | Clifton et al. | 166/127 |
| 4,671,352 | 6/1987 | Magee, Jr. et al. | 166/186 |
| 4,776,397 | 10/1988 | Akkerman | 166/241 |
| 4,794,989 | 1/1989 | Mills | 166/387 |
| 4,856,583 | 8/1989 | Greenlee et al. | 166/127 |
| 4,962,815 | 10/1990 | Schultz et al. | 166/387 |
| 5,082,062 | 1/1992 | Wood et al. | 166/382 |
| 5,090,481 | 2/1992 | Pleasants et al. | 166/373 |
| 5,092,402 | 3/1992 | Perricone et al. | 166/113 |
| 5,186,258 | 2/1993 | Wood et al. | 166/387 |
| 5,203,412 | 4/1993 | Doggett | 166/186 |
| 5,355,953 | 10/1994 | Shy et al. | 166/250 |
| 5,366,019 | 11/1994 | Brooks . | |

*Primary Examiner*—Hoang C. Dang
*Attorney, Agent, or Firm*—Rosenblatt & Redano, P.C.

[57] ABSTRACT

A straddle tool is disclosed which ensures sequential setting of the packing elements through the use of lost motion mechanisms. Once the lower pack-off has been set, the upper one is set and an internal valve is opened to allow flow through the tool to actuate a downhole tool, such as an inflatable packer. An anchor prevents actuation of the pack-off tool unless it is extended into a profile for support of the tool. Inadvertent settings of the pack-off tool are prevented, such as in oversized casing where the anchors are already fully extended, by virtue of a distance-sensing mechanism on the tool. When a large distance is sensed by one or more sensors, the mandrel is locked to the setting collars, preventing relative movement which could set the pack-off elements.

30 Claims, 9 Drawing Sheets

HORIZONTAL INFLATION TOOL SELECTIVE MANDREL LOCKING DEVICE

FIELD OF THE INVENTION

The field of this invention relates to a system for sequentially setting weight-set packer elements on a straddle-type packer in a tubular casing or pipe member in a wellbore, and more particularly to a system where the packer elements can be utilized to isolate a segment of a pipe in the wellbore and a valve can be selectively operated to place a string of tubing and the isolated segment of pipe in fluid communication for transferring liquid between the isolated segment of pipe and the string of tubing. The system can utilize a well tool which can be selectively anchored with respect to a tubular member and which can selectively open the valve in the well tool by longitudinal motion of a string of tubing. The invention has a specific application to systems for selectively and sequentially setting weight-set packer elements in a desired order in a tubular member such as an inflatable packer disposed in a pipe string in a wellbore.

BACKGROUND OF THE INVENTION

Horizontal drilling of a wellbore involves a technology where an initial segment of a wellbore extends in a generally vertical direction and then is angled in a direction which can be normal to a vertical or with other angular relationships with respect to the initial vertical segment of the wellbore. Where a horizontal or nonvertical section of the wellbore traverses earth formations which contain hydrocarbons, it is desirable to isolate selected formations from one another along a segment of the wellbore, and this isolation can be accomplished with an inflatable packer. In other instances, it may be desirable to perform treating operations such as acidizing or fracturing or gravel-packing the wellbore.

The present invention provides a practical system for ensuring the sequential setting of weight-set straddle packer elements in a well pipe and in a wellbore in horizontal or nonvertical sections of a wellbore as well as in vertical sections of a wellbore.

A problem can occur with the operation of weight-set straddle packer elements is that the setting force typically is applied through an upper collar, an upper packer element, and an intermediate collar to the lower packer element. By making the resiliency of the lower packer element less than the resiliency of the upper packer element (or stated another way, making the upper packer element harder than the lower packer element), the lower packer element is intended to expand first into a sealing relationship with the well pipe and then the upper packer element is intended to expand secondly into sealing engagement with the well pipe. Unfortunately, the downhole pressure and temperature can have an adverse effect on the desired resilient properties of the packer elements which can cause the upper packer element to expand before the lower packer element has achieved a complete sealing relationship with the well pipe so that the desired straddle packing is not obtained. Another concern is if pipe sizes are dissimilar at the elements and the upper is closer to the wall than the lower, then the upper sets first and the lower element would not achieve a complete sealing relationship and good sealing would not be obtained. Furthermore, the manufacturing of the packer element has to be carefully controlled and adjusted to obtain the relative resiliency of packer elements and can be unpredictable. It is not practical to test the packer elements for resiliency characteristics. Another problem that occurs in setting straddle packer elements is the friction grip of the packer elements against a well pipe also causes packer element damage when force is applied to an upper set packer element to attempt to increase the sealing pressure of the lower packer element.

In U.S. Pat. Nos. 5,082,062 and 5,186,258, a system is disclosed where an inflatable packer in a string of pipe in a wellbore has a latching profile member. A straddle tool carried on a string of tubing is receivable in the inflatable packer and is mechanically arranged to have latching fingers for selectively engaging the latching profile member so that downward motion on the string of tubing can be used to weight set the packer elements on the inflation tool in the inflatable packer and so that cement or mud slurry can be used to pressure inflate the inflatable packer. After the packer elements are set, a valve in the straddle tool is opened to place the string of tubing attached to the straddle tool in fluid communication with the inflatable packer.

In this system, the packer elements are intended to be sequentially set, but as discussed before, under certain conditions there can be unpredictable results.

SUMMARY OF THE INVENTION

The present invention is particularly useful in a system where a string of pipe is disposed in a wellbore which includes horizontal and angularly deviated wellbore sections and where the string of pipe has one or more locations where it is desired to utilize a weight-set straddle packer. For example, the present invention has use with one or more inflatable packers in a well casing or well pipe. Inflatable packer devices are well-known and can be inflated by the injection of a cement slurry or a mud slurry under pressure through an access port in the inflatable packer device. The liquid slurry under pressure fills and inflates an inflatable packer element along the elongated packer element, typically about 7–40 ft in length and is trapped in the packer. The inflated packing element on the inflatable packer isolates the wellbore with respect to an attached casing, liner, or drill-pipe.

The present system contemplates use of a well tool with straddle packing elements where the well tool at the end of a string of tubing can be inserted through an existing well pipe in the wellbore and located in a section of pipe to be isolated, such as the bore of an inflatable packer device. The well tool has its expandable packer elements located above and below a normally closed valve opening where the packer elements are positioned to straddle an access port in the well pipe or inflatable packer device. The well tool has latching elements which, when released, are spring-biased outwardly for register with a latching profile member in the well pipe or inflatable packer in a location below the inflatable packer so that the valve port between the straddle packers is properly located for communication with the access port of an inflatable packer or other device. When the latching elements are selectively released in a wellbore, longitudinal movement of the string of tubing is used to locate and to positively latch the latching elements in the latching profile member.

The packer elements on the well tool are located on tubular upper and lower sleeve portions of a tubular intermediate collar with a valve port located intermediate of the sleeve portions. The intermediate collar is associated with a lower expander collar located on the lower sleeve portion below the lower packer element where the lower collar expander can be retained in a fixed relationship to the well pipe when the latching elements are disposed in the latching profile member. An upper expander collar on the upper tubular sleeve portion above the upper packer element is coupled by a transfer locking means to a tubular central actuating mandrel and the intermediate collar is coupled by an intermediate collar-locking means to the central actuating mandrel. When the central actuating mandrel is actuated or moved by longitudinal movement of the string of tubing, the intermediate collar-locking means causes the intermediate collar to positively set the lower packing element independently of and prior to any setting action on the upper packer element. After the lower packer element is set to a predetermined load valve, the intermediate collar-locking means is released. The central actuating mandrel and the upper collar, which are coupled together by the transfer locking means, are then longitudinally movable relative to the intermediate collar to set the upper packer element. When the central actuating mandrel reaches a predetermined location relative to the intermediate collar where the upper packer element seals off the pipe, the transfer locking means are released which releases the central actuating mandrel relative to the upper expander collar. The central actuating mandrel can continue to move relative to the intermediate collar to open a valve in the central actuating mandrel so that there is fluid communication between the string of tubing and the portion of the well pipe isolated by the straddle packer elements. In the further downward movement of the central actuating mandrel, a shoulder on the central actuating mandrel is arranged to engage the upper expander collar and permit additional weight to be applied to the set packer elements.

A sealing dart is inserted into the string of tubing at the earth's surface and is followed by an inflating cement or mud slurry and is pumped down the string of tubing so that the slurry can be pumped into the inflatable packer device to inflate the packer element on the inflatable packer or to inject fluid into the isolated interval between the packer elements. Following inflation of the packer device and completion of the operation, the valve in the straddle well tool is closed by reversing the operation of the tool and the well tool is retrievable. In this operation, when the string of tubing is moved in an opposite longitudinal direction, (i) the valve closes, (ii) the upper expander collar locks to the central actuating mandrel for joint movement, (iii) the upper packer element is unset, (iv) the lower packer element is unset, and (v) the intermediate collar is locked to the upper expander collar for joint movement.

Relative upward movement of the lower sleeve portion of the well tool during the unsetting operation is resisted by the latching fingers being retained in the extended position in the latching profile member. When the well tool is in the fully retracted position, the latching fingers are located opposite their locking groove in the central actuating mandrel. Next, by further movement of the string of tubing, the latching members are released from the latching profile member and the well tool can be raised to the next above profile member and inflatable packer and/or retrieved from the well pipe. In this operation it can be appreciated that the fluid in the string of tubing is carried with the string of tubing to the next location. Any subsequent downward motion of the well tool to locate another latching profile member will not allow any of the fluid in the string of tubing to be released since the latching fingers lock the central actuating mandrel from moving and, hence, from opening the valve means.

When all of the inflatable packer or other devices in the string of pipe have been operated upon by the straddle well tool as described above, a circulation valve in the string of tubing is opened so that the liquid in the string of tubing can be reversed out to the earth's surface and also so that the string of tubing can be pulled "dry" from the wellbore.

During an entire operation of inflating inflatable packer devices, a slurry contained within the string of tubing can be used to selectively inflate one or more packer elements of inflatable packer devices located in a string of pipe in a well-bore and is retrievable with the well tool upon completion of the operations or can be reversed out of the tubing string without leaving cement in the wellbore.

A locking mechanism is also provided which senses the distance between the tool and the nearest tubular wall. In the preferred embodiment, a series of dogs sense the distance. If any one of a plurality of dogs extends outwardly beyond a predetermined distance, a detent prevents relative movement between the mandrel and a collar, thereby preventing setting of the tool. Normally, if the anchor is not fully extended out of a groove in the mandrel, relative motion will be impeded, thus preventing setting of the packing elements. However, if due to previous operations the anchor has been released and a large casing is encountered, inadvertent setting of the packing elements is prevented by the lock-out feature.

DETAILED DESCRIPTION OF THE PREFERRED EMBODIMENT

Figure 1:
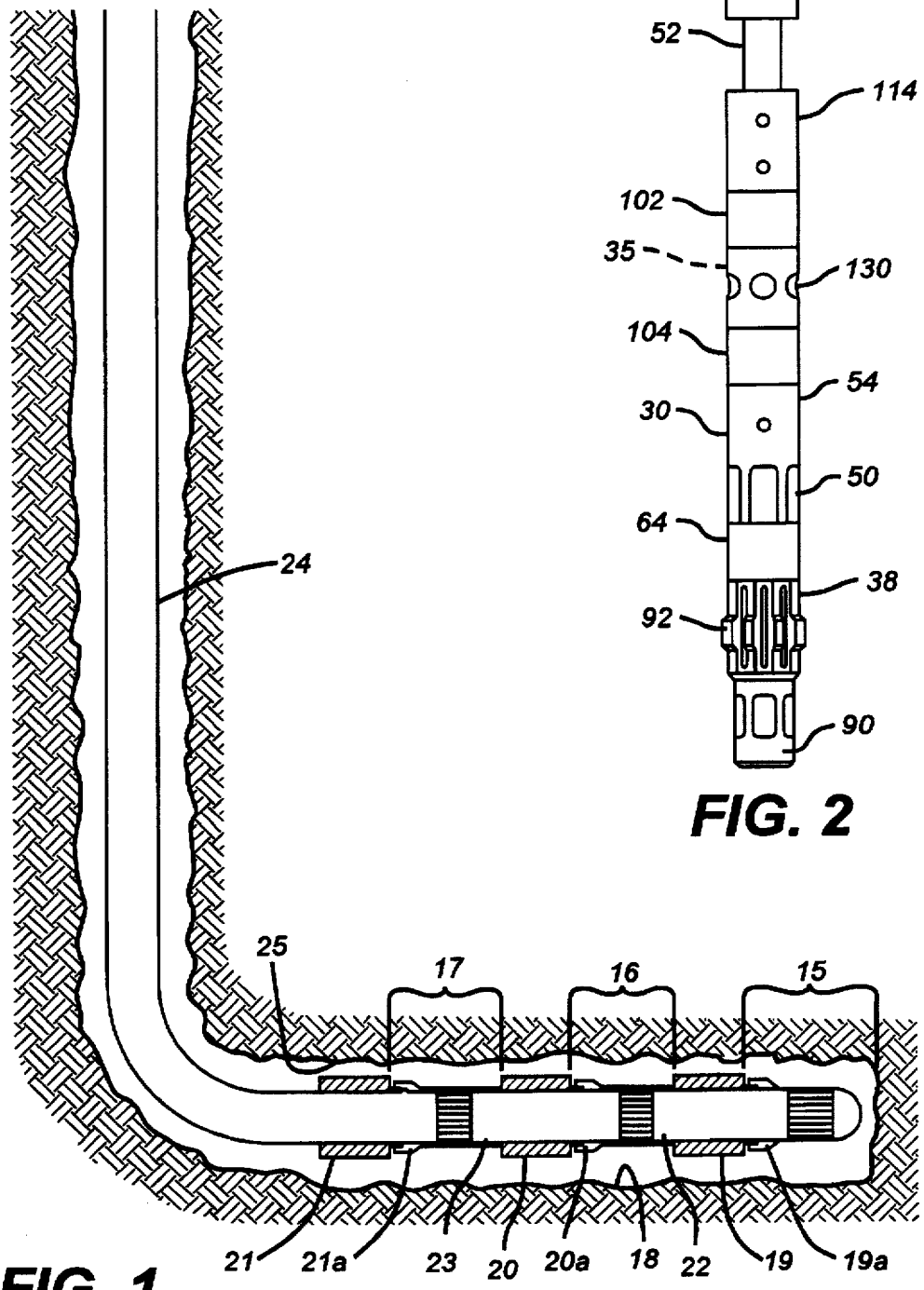
FIG. 1 is a schematic representation of an application of the present invention in a wellbore environment.

Referring to FIG. 1, in completing well zones such as the zones 15, 16 and 17 indicated in the drawings where there is a horizontal section or nonvertical section 18 of wellbore. Spaced apart inflatable packers 19, 20 and 21 are connected to one another by interconnecting pipe members 22 and 23 and are connected by a string of pipe or casing 24 to the surface of the ground. The section of pipe 22 and 23, located between the inflatable packers 19 and 20 and between packers 20 and 21, can be solid, pre-slotted or can be perforated for fluid flow before the inflatable packers are expanded.

The inflatable packers can be, for example, of the type illustrated in U.S. Pat. No. 4,402,517 where an elongated elastomer packer element is disposed about a central metal tubular member. The valving for the inflation of the packer element is preferably at an upper end of the tool and serves to control the admission of cement and inflation of the packer element. In the present invention, a knock-out cap is not required and an access opening to a pressure inflation valve is at the inner wall of the central member. When a liquid cement or mud slurry is introduced through the pressure inflation valve into an annular space between the inflatable packer element and a central tubular member, the packer element is inflated into sealing engagement with the wall of the wellbore 25, thereby providing fluid tight seal of the wall of the wellbore with respect to the central tubular member of the inflatable packer. It can be appreciated that where the inflatable packers are spaced from one another, the zone intermediate of adjacent inflatable packers can be produced through perforations in the connecting pipes 22 or 23 to the ground surface.

Associated with each packer 19, 20 and 21 is an anchor profile member 19*a*, 20*a*, and 21*a*. The profile members 19*a*, 20*a*, and 21*a* are respectively located below, on the lower end of an inflatable packer, or in an inflatable packer.

Figure 2:
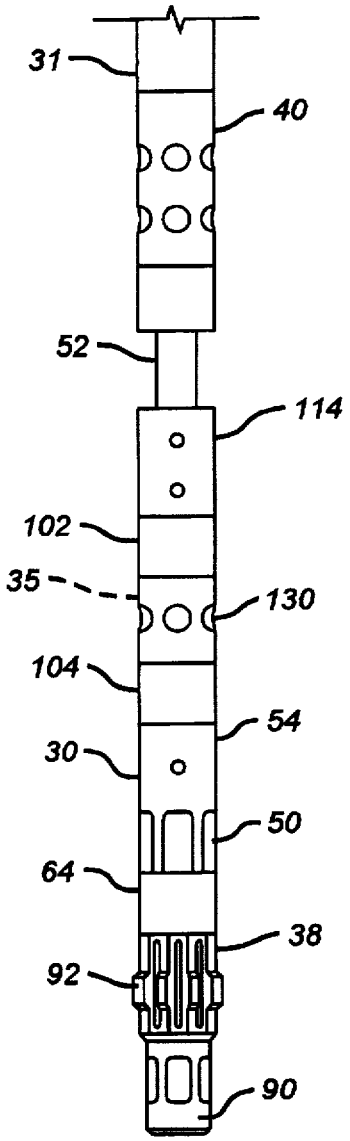
FIG. 2 is an outline illustration of an assembled well tool in which the present invention can be incorporated embodying the present invention.

FIG. 2 illustrates a configuration of a selectively operated well tool 30 which can be inserted through a string of pipe 24 at the end of a string of tubing or work string 31 to a location within the lowermost inflatable packer 19 or the inflatable packer which is the most remote from the end of the string of pipe located at the earth's surface. The selectively operable well tool 30 can be located and anchored by anchor means 50 with respect to an annular profile member, for example, 19*a* (FIG. 1), so that a pair of spaced apart weight-set packer elements 102, 104 on the well tool 31 can be expanded by compression to isolate a valve opening (not shown) in an inflatable packer device (not shown in FIG. 2). The well tool 30 is then operated to place a valve opening 130 in the well tool into fluid communication with the isolated valve opening in the inflatable packer device so that liquid cement slurry can be pumped down the string of tubing 31 and moved through a selectively opened valve in the well tool 30 and the valve opening 130 to the isolated valve opening of the inflatable packer device, which is located between the spaced apart sealing elements 102, 104 on the selectively operated well tool 30. When the liquid cement slurry is passed through valve opening 130 between the packer elements 102, 104 on the well tool 30 and enters into the access opening of an inflatable packer device, the packer element on the inflatable packer device is inflated by the slurry.

When the inflatable packer element is fully inflated and is in sealing operative condition in the wellbore, the operator picks up or lifts the string of tubing 31 which first closes the valve in the well tool 30 and prevents liquid cement slurry in the string of tubing 31 from escaping from the string of tubing. Further upward movement of the string of tubing then releases the packer elements 102, 104 on the well tool 30 and then releases the well tool 30 from its anchored position so that it can be moved or shifted to the next closest inflatable packer device.

When the well tool reaches the next inflatable packer device 20, the anchor means 50 on the well tool 30 is again set by a downward motion of the string of tubing so that the valve opening 130 is located proximate to the access opening of the inflatable packer device. After anchoring the well tool, the downward movement of the string of tubing selectively first sets the spaced apart packing elements 102, 104 on the well tool and then opens the valve in the well tool so that cement slurry in the string of tubing 31 can be introduced through the valve opening 130 to the access opening in the inflatable packer element and inflate this inflatable packer element to a sealing condition with respect to the wellbore wall. After this inflatable packer element is fully inflated, the string of tubing 31 is again picked up and the valve in the well tool 30 is first closed, followed by release of the packing elements 102, 104, followed by release of the well tool so that it can be moved from the inflatable packing element. As may be appreciated, this process can be sequentially operated on more than one selected packer device.

In the foregoing system, the well tool 30 has locating means 38 which serve to locate the well tool 30 relative to a profile member (19*a*, for example). The well tool 30 has the anchoring or latching means 50 (shown in retracted condition in FIG. 2) which are selectively movable outwardly of the well tool to engage a profile member. A central actuating mandrel 52 for the well tool is coupled to a circulating valve 40, which in turn is coupled to a string of tubing 31.

When the inflation of the inflatable packer devices is completed, the well tool 30 is located in a blank section of casing and pressure is applied in the annulus between the string of pipe and the string of tubing to open the pressure-operated circulating valve 40 in the string of tubing. When the circulating valve 40 is opened, the cement in the string of tubing can be pressured out through the string of tubing and returned to the earth's surface by pumping fluid through the annulus between the string of pipe and the casing, which is a well-known process known as reverse circulation. Alternately, a circulation valve which opens in response to internal pressure in the string of tubing could be employed, if desired.

In summary, a selective operating valve 35 (dashed line, FIG. 2) within the well tool, as well as the anchor means 50 in the embodiment illustrated, are sequentially operated by the tubular central actuating mandrel 52. Hydraulic pressure is utilized first to release the anchor means 50 relative to the central actuating mandrel 52. Then by slacking off, i.e., a downward movement of the central actuating mandrel 52 relative to the anchor means 50, the anchor means 50 is set in a profile member in the wellbore against downward movement relative to the well, the expandable packer elements 102, 104 on the well tool 30 are set and the valve 35 in the well tool is opened. A reverse motion of the central actuating mandrel 52 sequentially closes the valve 35, unsets the packer elements 102, 104, and releases the anchor means 50 from a profile member.

The foregoing tool description and operation is more fully detailed and explained in U.S. Pat. No. 5,082,062, issued Jan. 21, 1992, and U.S. Pat. No. 5,186,258, issued Feb. 16, 1993, both incorporated herein by reference as if fully set forth. The present invention is embodied in a well tool which can be operated in the same manner and utilize a similar anchor system. However, in the present invention the weight-set packer arrangement assures positive independent setting of packer elements and also a simplification of the valve system and its operation.

Figure 3A:
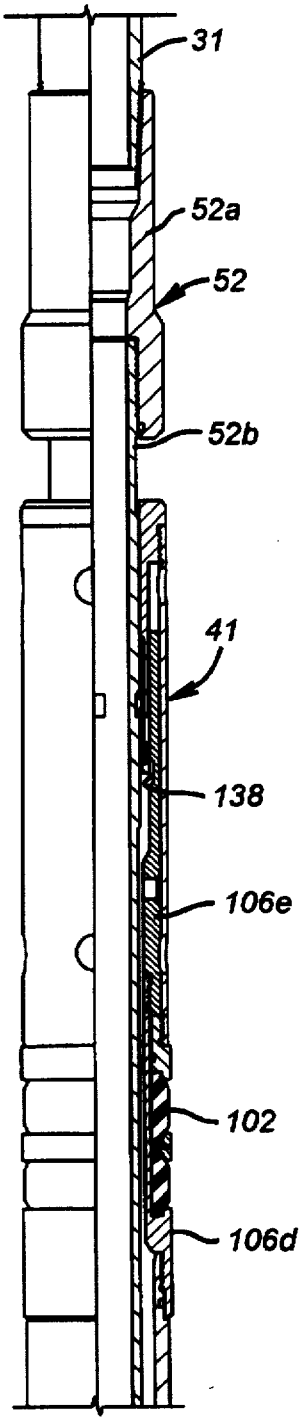
FIGS. 3A–C are views in longitudinal cross-section through a well tool embodying the present invention.
Figure 3B:
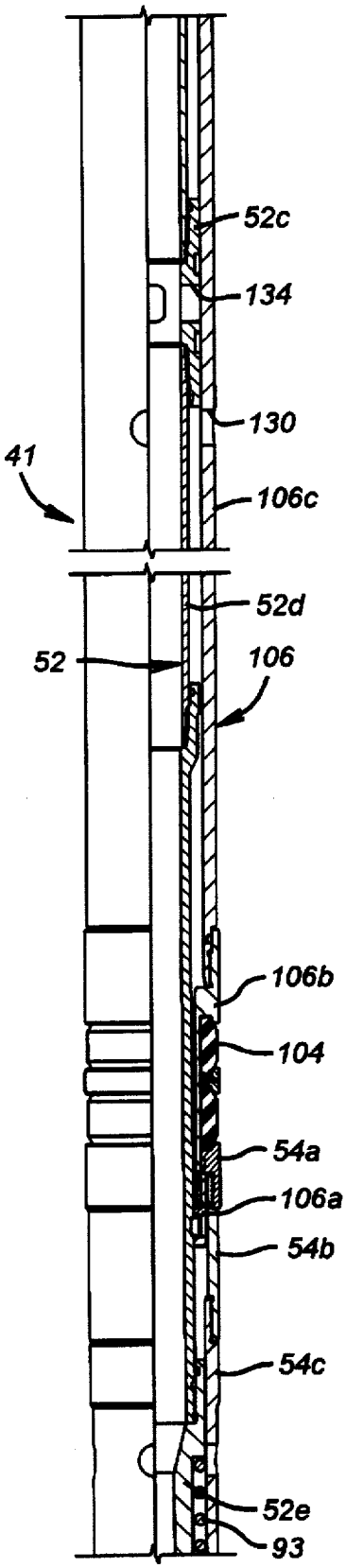
Figure 3C:
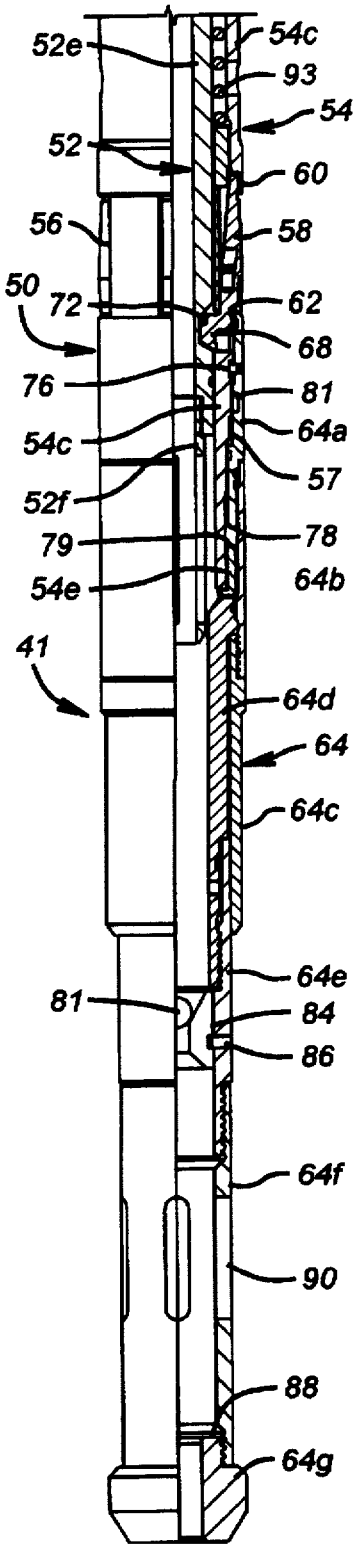

Referring now to FIGS. 3A–C, a well tool 41 similar to the well tool of U.S. Pat. Nos. 5,082,062 and 5,186,258 is illustrated. This well tool can have similar characteristics of operation as described with respect to the well tool 30 in FIG. 2. The well tool 41 can include an anchor means 50 located on the lower end of tubular actuating mandrel 52 as shown in the referenced patents or could employ other types of anchor means.

A tubular lower expander collar 54 (FIGS. 3B–C) is disposed about the terminal end of the central actuating mandrel 52 and has circumferentially spaced elongated recesses 56 (FIG. 3C) which receive elongated dog elements 58. The lower expander collar 54 is comprised of a number of interconnected tubular parts (54*a–c*, FIGS. 3B–C). The dog elements 58 have a somewhat triangular configuration in longitudinal cross-section with an outer curved surface in transverse cross-section which aligns within the outer cylindrical configuration of the well tool in an initial unactuated condition of a dog element. A dog element 58 is held in the initial retracted condition by an upper lip segment 60 (on part 54*c*) which extends over a recess 56 in the lower expander collar 54 and by an annular wall 62 of a tubular locking collar 64. The wall 62 engages a lock recess or notch in the outer surface of a dog element 58. The locking collar 64 is comprised of a number of interconnected tubular parts (64*a–g*).

At the lower inner end of a dog element 58 is a tab 68 which extends through an opening in the wall of the lower expander collar 54 (part 54*c*) and is lodged in an annular recess 72 in the central actuating mandrel 52. Each dog element 58 has an internal pair of blind bores which receive compressed spring members to resiliently urge a dog element 58 outwardly of the well tool. Thus, in the position of a dog element 58 shown in FIG. 3C, the dog elements 58 are confined within the cylindrical configuration of the well tool, the spring members are compressed, and the tabs 68 interlock in the recess 72 to releasably couple the central actuating mandrel 52 to the lower expander collar 54.

The locking collar 64 in a first position is releasably coupled to the lower expander collar 54 by shear pins 76 (FIG. 3C). When the shear pins 76 are sheared, the locking collar 64 can slide downwardly on the lower expander collar 54 until facing surfaces 78, 79 on the lower expander collar 54 and the locking collar 64 abut one another in a second position. The locking collar 64 has an internal annular recess which contains a snap ring 81 and the latching collar 54 has a longitudinally displaced external recess 57. When the facing surfaces 78, 79 abut one another in the second position, the snap ring 81 will latch into the external recess 57 to retain the locking collar 64 in the second position. In the second position, the annular wall 62 is displaced from the dog element 58 and the dog element 58 can spring outwardly relative to the outer cylindrical configuration of the well tool. The arrangement is such that the tab 68 will not release the locking collar 54 from the central actuating mandrel 52 until the dog element 58 is in an annular latching recess or profile groove, such as 19*a* (see FIG. 1), in a well pipe or other tool. The length of the dog elements 58 is such that the elements are longer than pipe gaps at collars and will not be falsely anchored in a casing collar groove. When a dog element 58 is in a latching groove, such as 19*a*, in a well pipe or tool, the tab 68 is removed from the recess 72 in the central actuating mandrel 52 so that the central actuating mandrel 52 is released for movement relative to the lower expander collar 54.

At the lower end of the locking collar 64 is a bore section which contains an annular plug seat 84 for receiving a sealing plug member or ball member 81. A sealing plug member may be pumped down the string of tubing so that it seats in the bore of the plug seat 84 and hydraulic pressure can be applied to the locking collar 64 to shear the shear pins 76 which releasably connect the lower expander collar 54 to the locking collar 64. Alternately, a ball sealing member can be run in place on the plug seat 84 so that flow is possible past the ball member while running the string of tubing in the wellbore. Tubing pressure is used to urge the ball member into the plug seat 84 and hydraulic pressure can be applied to the locking collar 64 to shear the shear pins 76 which releasably connect the lower expander collar 54 to the locking collar 64. The plug seat 84, as illustrated in the drawings, is in an annularly shaped sleeve and is shear-pinned by shear pins 86 to the locking collar 64. If the pressure on the sealing plug is increased to a value above the shear pin value for the shear pin 86, the shear pin 86 will release and the plug seat 84 will move downwardly in the locking collar 64 to a lower position in engagement with a catcher flange 88 on the locking collar 64. In this position of the plug seat, a bypass opening 90 in the locking collar 64 is open for communication between the interior of the bore through the tool and the exterior of the well tool.

In FIG. 2 and in U.S. Pat. Nos. 5,082,062 and 5,186,258, locating collet fingers tubular cage member 92 provides a locating function. While this system can be used, it is not illustrated with the tool shown in FIG. 3C. In the system shown in FIGS. 3A–C, a sleeve 64*e* and a spring 93 provide an additional force on the expander collar 54 and are an optional feature.

Referring now to FIGS. 3A and B, the selectively operated valve 35 in the well tool includes the central actuating mandrel 52 with a valve port 134 which operates in conjunction with straddle packer elements 102, 104 and a tubular packer support member 106 which has a valve port or opening 130. The support member 106 is a tubular member disposed about the central actuating mandrel 52 and consists of a number of interconnected parts 106*a–e* (FIGS. 3A and B). As illustrated in the drawings (FIG. 3B), the lower expander collar 54 (part 54*a*) has a downwardly facing internal shoulder which engages an upwardly facing flange on the packer support member 106 (part 106*a*). The packer support member 106 (part 106*b*) has a lower support sleeve for the lower packer element 104 (shown in two parts and can be three parts, if desired). The intermediate part 106*c* of the support member 106 has the valve port 130. The upper packer element (shown in two parts but can be more parts) is supported by an upper support sleeve on part 106*d* (FIG. 3A). The end latching part 106*e* has an internal latching groove or recess 138.

The central actuating mandrel 52 includes interconnected parts 52*a–f* (FIGS. 3A–C) and extends between a string of tubing or work string 31 and the anchor means 50. The mandrel 52 with a first setting sleeve, such as 106*b–c*, and a second setting sleeve, such as 106*a*, are part of a first segment of the body of the tool. Anchor 58 when set holds collar 54, and other components which comprise a second portion of the body, stationary. The structure and operation of the selectively operated valve, the means for selectively setting the packer elements 102, 104 and the packer-setting operation, as well as the packer structure, may best be understood by reference to FIG. 4, which provides a simplified illustration of the structure shown in FIGS. 3A and B.

Figure 4:
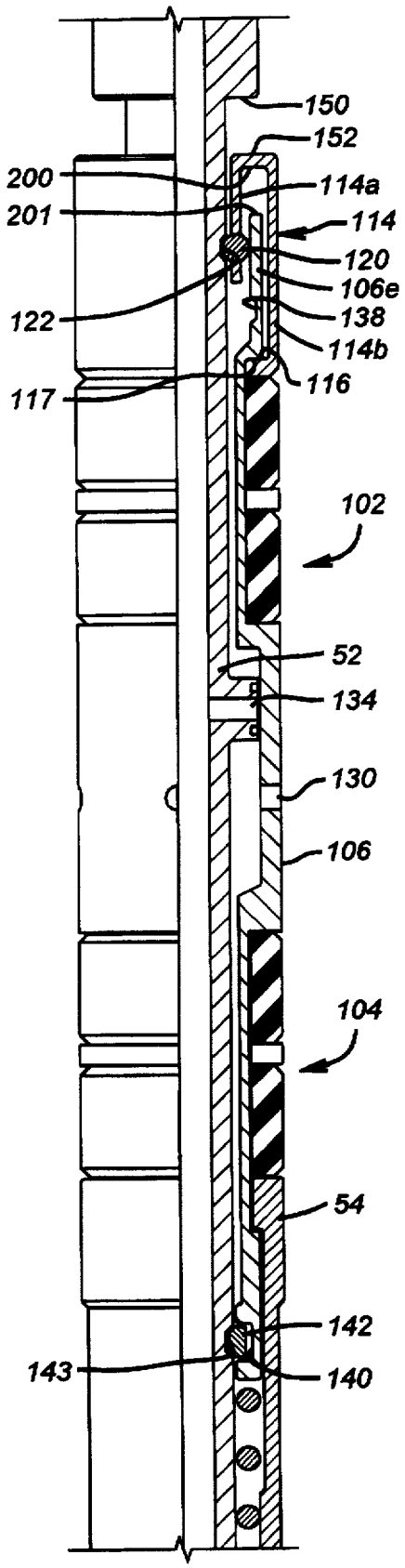
FIG. 4 is a schematic representation of the longitudinal cross-section of an embodiment of the well tool of the present invention.

As shown in FIG. 4, there is a tubular upper expander collar 114 which has an inner wall 114*a* and an outer wall 114*b*, wherein an annular space between the walls 114*a* and 114*b* slidably receives the end latching part 106*e* of the support member 106. The central actuating mandrel 52 has an annular recess 122 which receives inwardly, spring-biased, locking detent members 120. The detent members 120 are movable radially in detent openings 138 in the wall 114*a* but are held in a locked condition in the recess 122, as shown in FIG. 4, by the inner wall surface of the latching part 106*e*. Thus, the upper expander collar 114 is held in a locked position relative to the central actuating mandrel 52 so long as the detent members 120 are held in the recess 122 by the latching part 106*e* of the support member 106.

Figure 6:
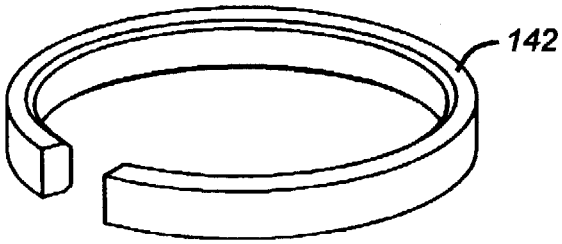
FIG. 6 is a view in perspective of a detent ring at the lower packing element used in the present invention.
Figure 10:
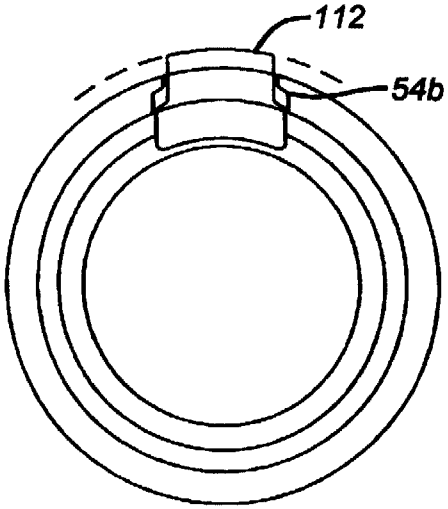
FIG. 10 is a section view along line 10—10 of FIG. 8, showing how the dogs in the locking system are retained to the collar segment to prevent their loss downhole.

Below the lower packer element 104, the support member 106 (part 106*a*) has an internal annular recess 140 which is located about a snap detent ring 142 where the snap detent ring resiliently seats in a snap ring recess 143 on the central actuating mandrel 52. The snap detent ring 142, as shown in FIG. 6, is an annular ring with a split opening or gap and is constructed from resilient material. The ring 142 snaps into the recess 143 and will be dislodged from the recess 143 when the downward force (with reference to FIG. 4) on the central actuating mandrel 52 exceeds the resilient retaining force of the ring 142 in the recess 143. The retaining force of the ring 142 can be preselected by design dimensions and material of the ring 142 relative to the recess 143. The snap detent ring 142 and the recess 143 provide a releasable locking means between the central actuating mandrel 52 and the support member 106 so that a force developed downwardly on the central actuating mandrel 52 is transmitted directly through the locking means, i.e., ring 142 in recess 143, to the support member 106 and directly applies force to expand the weight-set packer element 104. Since the support member 106 and the central actuating mandrel 52 and, consequently the tubular upper expander collar 114, move conjunctively with one another, there is no relative movement to set the upper packer element 102. When the dog elements 58 are in a latching profile member, i.e., 19*a*, the lower expander collar 54 is fixed or anchored and thus the packer element 104 can be set by relative movement between the expander collar 54 and the support member 106.

The force on the ring 142 is predetermined to a load where the ring 142 does not release until a predetermined setting force or load is applied to the packer element 104 to assure that it is in sealing engagement with the well pipe. When the ring 142 releases from the recess 143, the actuating mandrel 52 moves downwardly (with reference to FIG. 4) relative to the support member 106. The detent members 120 in the recess 122 transmit force via the expander collar 114 to the packer element 102 and set the upper packer element 102. When the travel of the expander collar 114 relative to the support member 106 is sufficient to set the upper packer element 102, and the downward facing surface 200 meets surface 201 in the annular space between 114*a* and 114*b*, the detent members 120 reach the transfer recess 138 in the support member 106 (part 106*e*) and release the central actuating mandrel 52 from collar 114, allowing it to move further down so that ports 130 and 134 can be aligned, while at the same time locking collar 114 to support member 106*e* at recess 138. With the packing elements 102 compressed, a radial force from them holds support member 106*e* until shoulder 150 hits surface 152. Additional downward movement of the central actuating mandrel 52 moves the valve port 134 down to align with the port 130 on the support member 106. Thereafter, a shoulder 150 on the actuating mandrel 52 engages a shoulder 152 on the expander collar 114 so that additional weight can be applied to the set packer elements 102, 104 to maintain the elements in a sealing condition.

The longitudinal spacing between the ports 134 and 130 of the valve is set so that the packer elements 102, 104 fully seal off in a pipe wall before alignment, and fluid communication can occur which is a preferable mode of operation.

To retrieve the tool, an upward pull on the work string moves the actuating mandrel 52 relative to the support member 106 to first close the valve by moving the valve ports 130, 134 out of fluid communication. Suitable O-rings or packing or molded seals can be utilized for fluid sealing and isolation as necessary. Next, the recess 122 will align with the inwardly spring-biased detent members 120 which permits locking of the central actuating mandrel 52 to the expander collar 114 and release of the upper packer element 102. After the upper packer element 102 is released, continued upward movement of the central actuating mandrel 52 will release the lower packing element 104. The mating faces 116, 117 on the outer wall 114*b* and the support member 106*e* are engaged. When the upper packer element 102 is fully unset, an upward movement of the central actuating mandrel 52 pulls the support member 106 upwardly, unsetting the lower packer element 104. Once the lower packer element 104 is fully released, the recess 143 aligns with the snap detent ring 142 in the recess 140 and the snap detent ring 142 interconnects the support member 106 to the central actuating mandrel 52.

Figure 5:
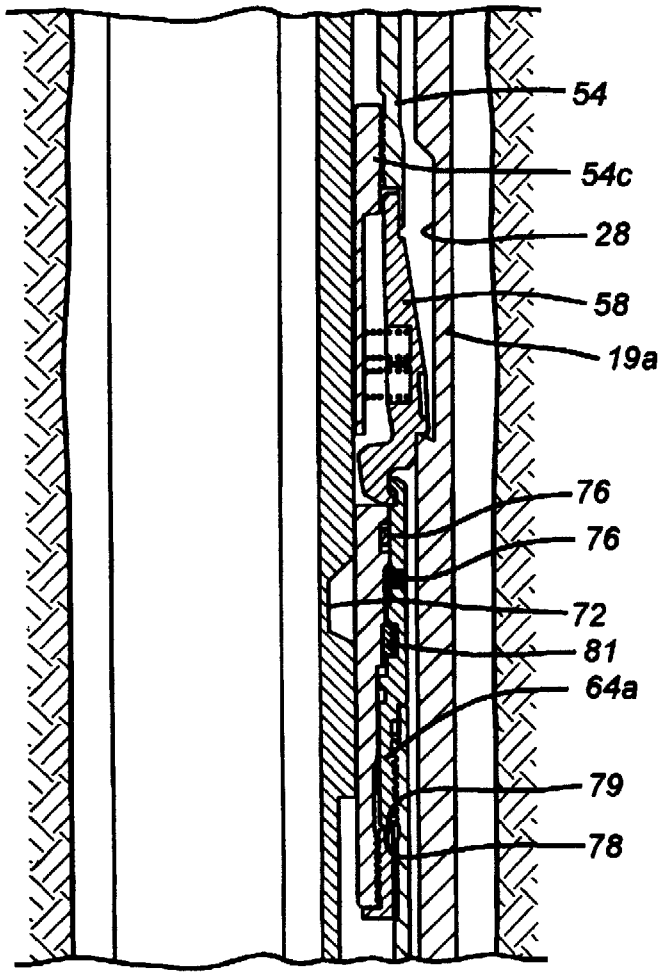
FIG. 5 is a view in longitudinal cross-section of a portion of the well tool to illustrate the latching elements of the anchoring means.

In operation for inflating an inflatable packer in a wellbore, the tool would be moved through the well pipe or casing to a position where the dog members 58 are located below a profile member 19*a* in the pipe. A sealing plug or ball is pumped down under pressure to seat in the plug seat 84. Pressure is applied to shear the pin 76 and release the dog members 58. Thereafter, additional pressure can be applied to release the plug seat 84 so the circulation of fluid can be obtained. The tool is then raised or moved in an opposite longitudinal direction to bring the dog members 58 above a latching recess 28 in a profile member 19*a* (see FIG. 5) so that subsequent downward movement in an opposite direction engages the released dog members 58 with the recess in the profile member 19*a*. When the dog members 58 are engaged or anchored in the profile member 19*a*, the lower packer element 104 is first set independently of the upper packer element by intercoupling of the actuating mandrel 52 with the support member 106 by the snap detent ring 142 and the recess 143. When the predetermined setting force or load on the lower packer element 104 is adequate for sealing with a pipe wall, the ring 142 is released from the actuating mandrel 52 so that the actuating mandrel 52 acts upon the upper packer element 102 through the interconnection of the locking detent members 120 and the recess 122. When the upper packer element 102 is fully set, further downward movement will allow the valve to be opened by communication of port 130 and port 134 and the work string 31 can be used to apply further weight to the packer elements 102, 104 by engagement of the shoulders 150, 152.

To unset the packer elements, a reverse movement of the work string closes the valve, couples the expander collar 114 to the actuating mandrel 52, unsets the upper packer element 102, couples the support member 106 to the actuating mandrel 52, and unsets the lower packer element 104. The snap detent ring 142 now engages the recess 143 and interconnects the support mandrel 106 and the central actuating mandrel 52. Next, dog members 58 are released from the profile member by relative movement.

Figure 7A:
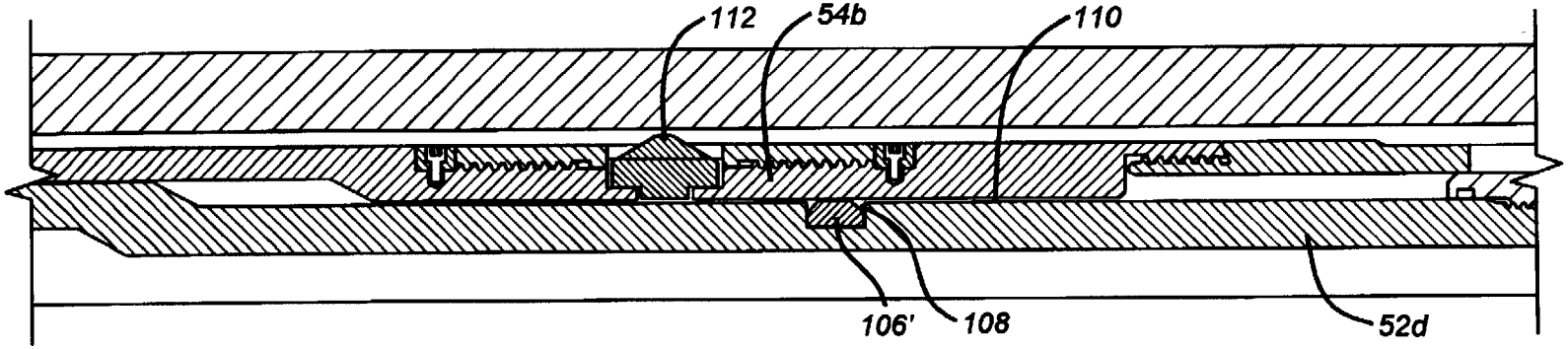
FIGS. 7A–B are a sectional elevational view, showing the apparatus in the latched position to a profile.
Figure 7B:
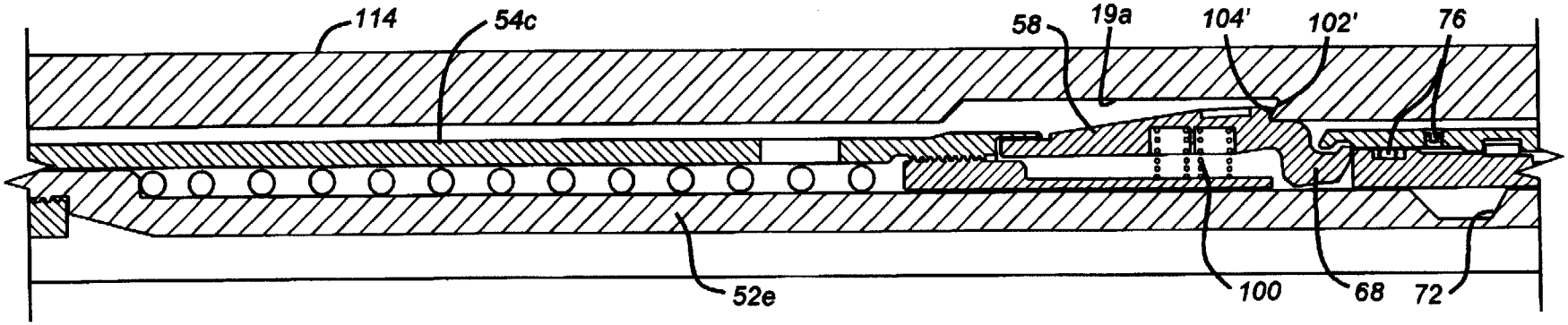

FIGS. 7–10 illustrate the lock-out feature that prevents the mandrel 52 from shifting with respect to lower expanding collar 54 if the dogs 58 are for any reason released in oversized casing. This can occur if for any reason pressure is applied to the tool when it is not properly located, which sets off the sequence of movements to liberate the dogs 58 by applying pressure on ball 81. As previously stated, the application of pressure on ball 81 breaks the shear pin 76, thus allowing the dogs 58 to move outwardly into the profile 19*a* under the force of spring 100. Another way is when the tool is moved in the wellbore after the dogs 58 have been initially released and a large casing is encountered. Thus, FIG. 7 illustrates the previously described sequence when properly performed in the appropriate location so that the dogs 58 properly grab the profile 19*a* due to the mating reverse shoulders 102', 104' coming together.

In the position shown in FIG. 7, the lock-out feature will be described. A C-ring or split ring 106' is disposed in groove 108 in segment 52*d*, as shown in FIG. 7A. The tendency of the C-ring 106' to move radially outwardly is resisted because in the position shown in FIG. 7, surface 110 of segment 54*b* covers over groove 108, preventing the C-ring 106' from springing outwardly. Offset from C-ring 106 are circumferentially disposed dogs 112, which are retained by segment 54*b* but can move radially outwardly. The segment 54*b* retains the dog or dogs 112 from falling out, as shown in the section view of FIG. 10. Accordingly, when properly inserted into the area where the profile 19*a* occurs, the size of the casing 114 or the surrounding sleeve being part of the packer or other downhole tool to be set is in dose proximity with the dogs 112, keeping them in a retracted position as shown in FIG. 7A. This permits relative longitudinal motion to set the packer elements 102', 104'.

Figure 8A:
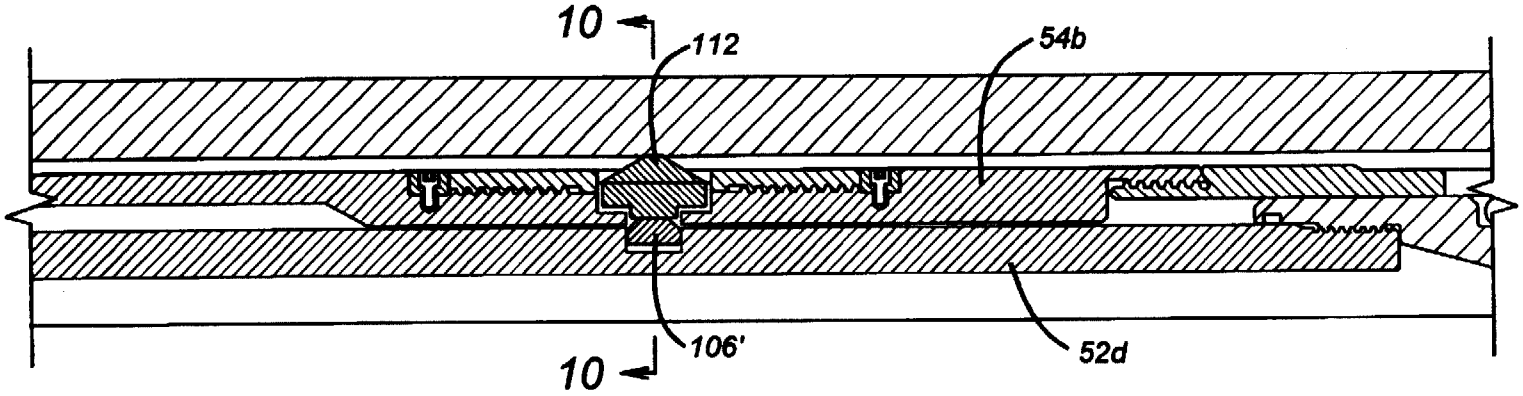
FIGS. 8A–B are a sectional elevational view, showing the apparatus of FIG. 7 with the dogs released in a narrow conduit which is insufficiently large to allow the dogs to move the full extent required for latching.
Figure 8B:
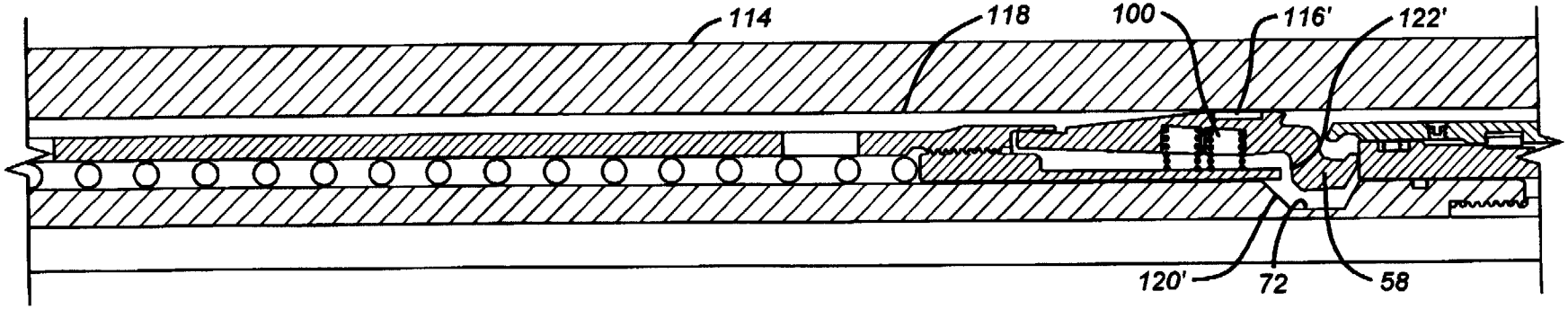

FIG. 8 is intended to show that even if the assembly of the present invention is further uphole in small casing, some relative movement can still be accomplished since the C-ring 106' does not protrude outwardly sufficiently to impede the relative movement between the mandrel segment 52*d* and the collar segment 54*b*. This is shown in FIG. 8A. Again, in FIG. 8A, the dogs 58 have been liberated for outward movement, responsive to the spring or springs 100. However, since the casing or tubular 114 is sufficiently small, the outward movement of the dogs 58 is limited when the wear pad 116', which can be made of tungsten carbide, contacts the interior surface 118 of the casing or sleeve 114 downhole. However, in the positions shown in FIG. 8B, the dogs 58 are not out far enough; therefore, relative longitudinal movement between the mandrel components 52 and the collar components 54 is stopped because the hook portion of the dogs 58 is still in part within the recess or groove 72, and spring 93 helps to resist downward motion of 52 with respect to 54. By virtue of portions of the dogs 58 still being in groove 72, attempts to downwardly move the mandrel 52 will stop at or shortly below the position shown in FIG. 8. This will occur when the tapered surface 120' hits surface 122' of dogs 58. All this presupposes that the tool has somehow lodged itself without the dogs 58 landing in a profile 19*a* within a fairly small conduit or tubular, which is insufficient to allow the dogs 58 to reach sufficient radial outward travel to get them out of the groove 72.

Figure 9A:
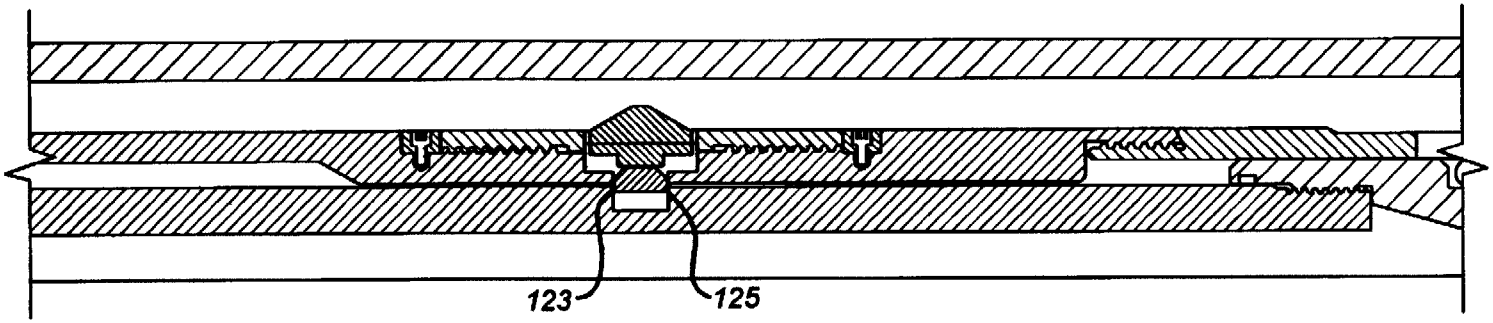
FIGS. 9A–B are a sectional elevational view of the tool as shown in FIGS. 7 and 8 except that it is in an oversized conduit but otherwise supported without the dog or dogs being in a profile, showing how the lock-out feature prevents relative movement for setting of the packing elements.
Figure 9B:
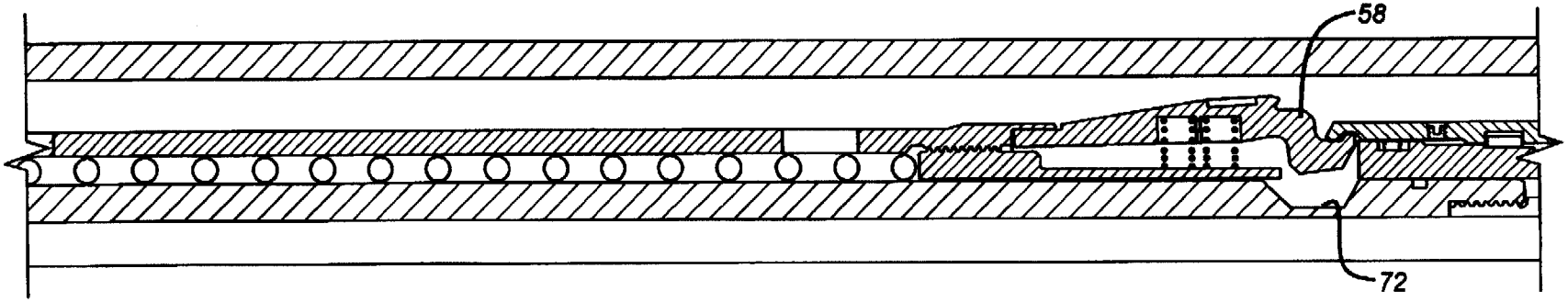

In the position shown in FIG. 8, the relative motion between mandrel 52 and collar 54 comes to a halt when the C-ring 106 is in alignment with the dogs 112. As seen by comparing FIGS. 7A and 8A, the C-ring 106 has somewhat expanded in FIG. 8A, pushing the dogs 112 outwardly into contact with surface 118. However, the C-ring 106 has not moved radially outwardly so as to lock the segment 52*d* to the segment 54*b*. In larger casing or conduits, it would be undesirable if the packer elements 102', 104' were to be set in an inappropriate location. Since the dogs 58 in FIG. 9B have room to move completely outwardly, taking them out of groove 72, the apparatus of the present invention now employs the C-ring 106 which, when fully aligned with the dogs 112 with nothing to retain the dogs 112 back into segment 54*b*, allows the C-ring 106 to move outwardly radially sufficiently to straddle segment 52*d* of the mandrel and 54*b* of the collar. Thus, relative longitudinal movement is impeded when the C-ring 106 is in the position shown in FIG. 9A. As previously stated, the segment 54*b* retains the dogs 112 from complete outward movement, thereby preventing their loss downhole. As shown in FIG. 9A, the dogs 112 have reached their extreme outermost movement, as has the C-ring 106 directly behind it. In the position shown in FIG. 9A, the C-ring 106 has opposed surfaces 122 and 124 which straddle the mandrel 52 and the collar 54. Accordingly, there is no way to set the packing elements 102, 104 when such relative movement is not permitted by the C-ring 106. As long as one dog 112 is not radially compressed, the C-ring 106 will still lock mandrels 52 and collar 54. When the tool is offcenter in a tubular, this can occur. The apparatus would then need to be literally removed from the wellbore or repositioned and rerun to avoid whatever obstruction it might be catching on.

Other types of lock-out mechanisms that sense the size of the surrounding tubular to selectively allow relative movement when that gap is within predetermined limits are all within the scope of the invention. While a longitudinal lock is illustrated, other locks against other types of movement are contemplated, depending on how the subject tool is actuated.

Figure 11A:
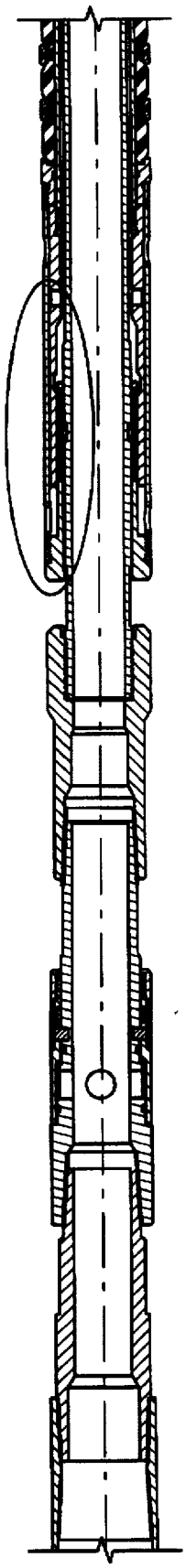
FIGS. 11A–C are similar to FIGS. 3A–C showing an embodiment where the ball is preassembled to the tool and retained against loss by a crossbar, as well as illustrating how pressurizing the ball shifts an outer sleeve to allow opening of a circulation port.
Figure 11B:
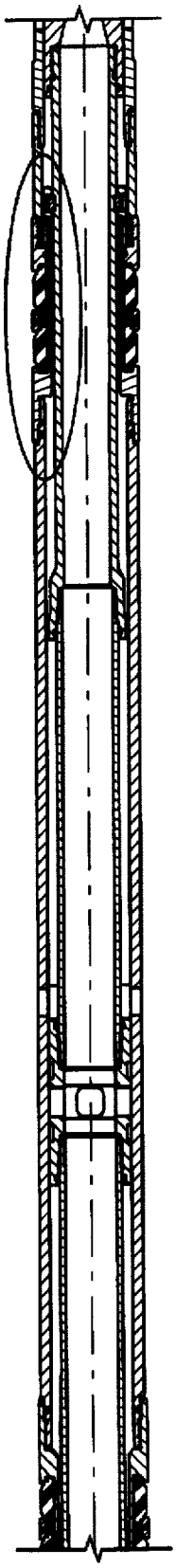
Figure 11C:
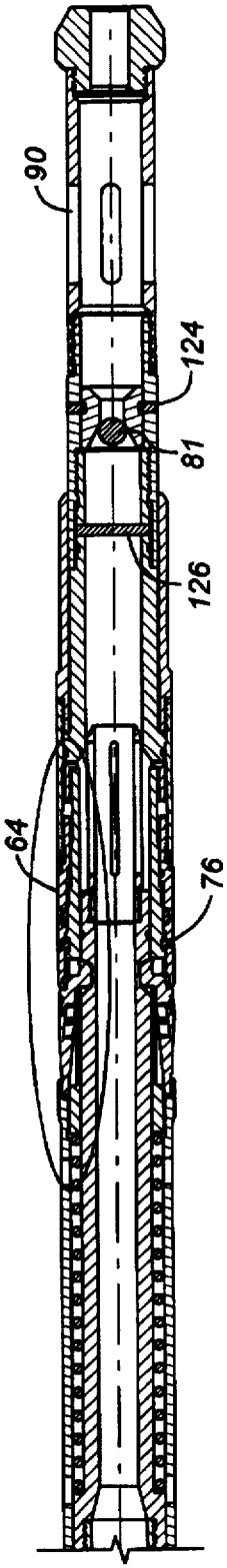
Figure 12:
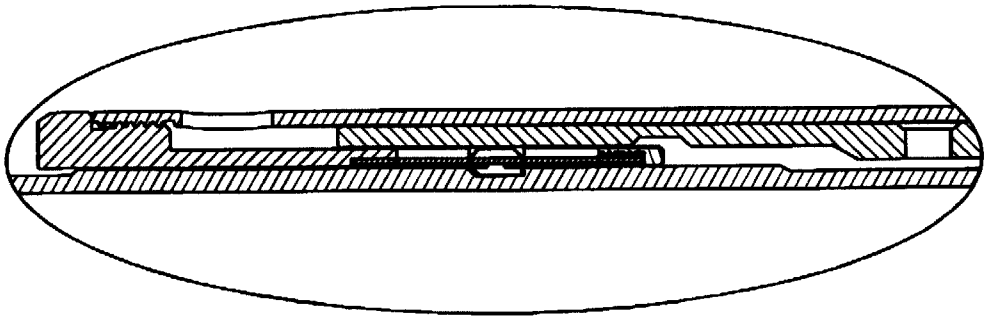
FIG. 12 is a detailed view of the lost motion feature adjacent the upper packing element.
Figure 13:
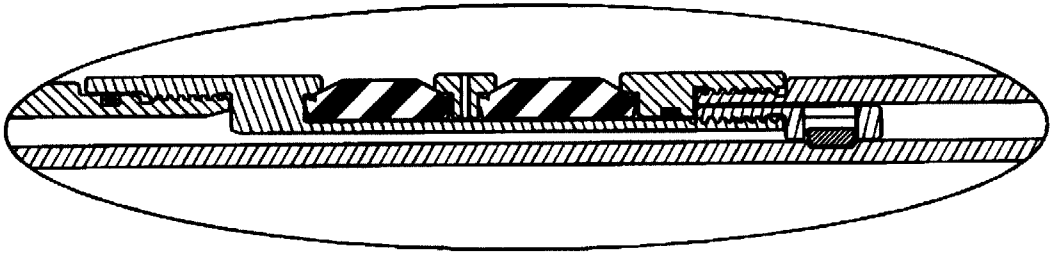
FIG. 13 is a detailed view of the lost motion feature adjacent the lower packing element.
Figure 14:
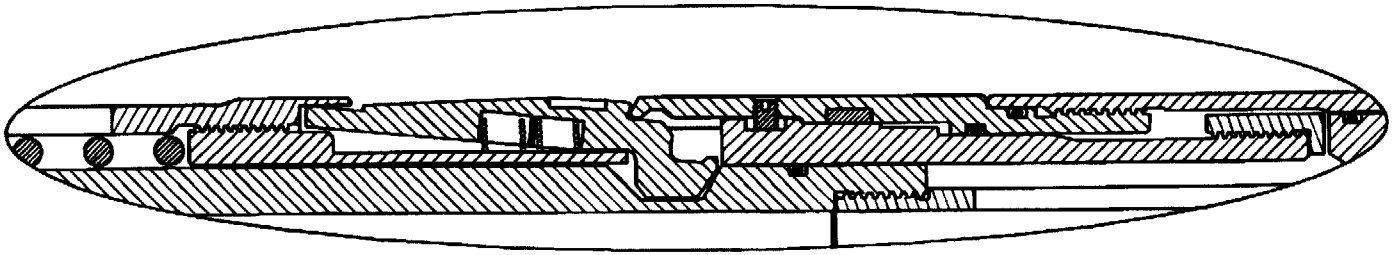
FIG. 14 is a detailed view of the apparatus adjacent the dogs.

FIGS. 11A–C are similar to FIGS. 3A–C with a few variations involving the ball 81, which when subjected to pressure breaks the shear pins 124, which ultimately breaks shear pins 76, moving the outer sleeve 64 downwardly, while at the same time the ball 81 travels with its seat sufficiently downwardly to open up circulation passages 90.

Those skilled in the art will appreciate that this type of a straddle tool can be used for actuation of various hydraulically set tools, using a variety of fluid media. The advantage of the apparatus as described above is that in a smooth motion, it actuates a sealing member such as 104 and then ensures subsequent sequential setting of the other sealing member 102. Although two sealing members have been shown, the same concepts can be employed to actuate a plurality of sealing members in a sequential order, with a uniform movement. Although the preferred embodiment of the apparatus has been illustrated using a set-down force to obtain the straddle seal off and the opening of the internal valve, the dogs can be oriented in a reverse manner into a different type of a profile so that the actuation of the apparatus can be accomplished by applying a tensile force rather than a set-down compressive force. While a specific illustration of the lost motion feature has been disclosed to ensure sequential setting of the sealing elements 102, 104, other mechanisms or movements which ensure the preferential setting of one sealing element before another in the context of uniform motion are all within the scope of the invention. While the invention has been shown to be particularly useful in the inflation of inflatable packers with various fluids, it is within the scope of the invention to use the apparatus for actuation or operation of other hydraulically actuated downhole tools by virtue of a straddling of the inlet port to such a tool with sealing elements, followed by the introduction of pressurized fluid. The advantages of the invention, when using cement or other hardening materials for the fluid to inflate a packer, can be readily seen since, with the internal valving mechanism using valve port 134, the cement stays within the tool, thus allowing in a single trip multiple inflatable packers or other types of tools to be set without fear of depositing cement in a position where it will later have to be drilled out.

The foregoing disclosure and description of the invention are illustrative and explanatory thereof, and various changes in the size, shape and materials, as well as in the details of the illustrated construction, may be made without departing from the spirit of the invention.

I claim:

1. A downhole tool comprising:

a body comprising a first portion having a plurality of components and a second portion;

an anchoring device selectively actuable to support said second portion of said body downhole;

at least a first and a second sealing member actuable by relative movement of at least one of said first body portion components with respect to said second body portion when said second body portion is anchored in the wellbore by said anchoring device;

said first body portion comprises a mandrel, a valve member, and a first and second setting sleeve, respectively adjacent said first and second sealing members;

a releaseable locking member operatively connecting said mandrel and said first setting sleeve for tandem movement with respect to a now fixated said second portion of said body, to actuate said first sealing member with a predetermined compressive force whereupon said locking member releases said mandrel from said first setting sleeve to allow subsequent actuation of said second sealing member; and a detent assembly releaseably holding said mandrel and said second setting sleeve against relative movement to preclude application of an actuating force to said second sealing member until or after said locking member has released whereupon said detent member releases to permit said mandrel to release from said second setting sleeve whereupon further movement of said mandrel activates said second sealing element by forcing said second setting sleeve toward said first setting sleeve.

2. The tool of claim 1, wherein:

said releasable locking member comprises a first detent in a first mating groove on said mandrel, extending into contact with said first setting sleeve, whereupon compression of said first sealing member a sufficient force is transferred to said first detent to remove it from said first mating groove to allow said mandrel to advance relative to said first setting sleeve.

3. The tool of claim 2, wherein:

said detent assembly, upon further movement of said mandrel after said removal of said first detent from said first mating groove, moving said second setting sleeve to compress said second sealing member.

4. The tool of claim 3, wherein:

said detent assembly comprises a second detent mounted in a second groove to said mandrel;

said second setting sleeve comprising an opposed third groove to said second groove;

said second detent movable from said second to said third groove to retain a compressive force on said first and second sealing members while allowing said mandrel to continue its movement.

5. The tool of claim 4, wherein:

said mandrel cams said second detent from said second to said third groove upon their alignment.

6. The tool of claim 4, wherein:

said valve member is mounted to said mandrel and further comprises a lateral port;

said first setting sleeve comprising a lateral port whereupon further movement of said mandrel with said second detent in said third groove, said ports align, allowing flow through said body and laterally outwardly between said now compressed first and second sealing members.

7. The tool of claim 6, wherein:

said lateral ports come into alignment when said mandrel engages a travel stop adjacent said second setting sleeve.

8. The tool of claim 4, wherein:

said second detent is biased toward said second groove by at least one biasing member extending through it and oriented longitudinally with respect to said second setting sleeve.

9. The tool of claim 1, wherein:

said mandrel comprises an anchor groove to house at least a portion of said anchoring device until actuated;

said anchoring device retained in a retracted position by a sliding sleeve;

whereupon movement of said sleeve, said anchoring device is biased outwardly to engage a mating profile already in a wellbore;

said mandrel precluded from moving sufficiently to set said first and second sealing members until said anchoring device exits said anchor groove.

10. The tool of claim 9, further comprising:

a distance sensor on said second portion of said body to detect the distance to the nearest downhole tubular;

a detent on said mandrel selectively permitting relative movement between said mandrel and said second portion of said body unless a distance above a predetermined value is sensed by said sensor, whereupon said detent locks said second portion of said body to said mandrel, even if said anchoring device has moved out of said anchor groove.

11. The tool of claim 10, wherein:

said mandrel comprises a locking groove having a lock ring biased to move out of said locking groove;

said distance sensor comprises a plurality of movable dogs which keep said lock ring compressed in said locking groove in a first position and upon moving outwardly to sense distance having an outward travel stop which, when reached, allows said lock ring to expand partly out of said locking groove and toward said second portion of said body to lock together said mandrel and said second portion of said body.

12. The tool of claim 11, wherein:

said mandrel is locked to said second portion of said body when at least one of said dogs has moved outwardly to sense a predetermined distance.

13. The tool of claim 1, further comprising:

an anchor groove on said mandrel;

a distance sensor on said second portion of said body to detect the distance to the nearest downhole tubular; and a detent on said first portion of said body selectively permitting relative movement between said first portion of said body and said second portion of said body unless a distance above a predetermined value is sensed by said sensor, whereupon said detent locks said second portion of said body to said first portion of said body, even if said anchoring device has moved out of said anchor groove.

14. The tool of claim 13, wherein:

said first portion of said body comprises a locking groove having a lock ring biased to move out of said locking groove;

said distance sensor comprises a plurality of movable dogs which keep said lock ring compressed in said locking groove in a first position and upon moving outwardly to sense distance having an outward travel stop which, when reached, allows said lock ring to expand partly out of said locking groove and toward said second portion of said body to lock together said first portion of said body and said second portion of said body.

15. The tool of claim 14, wherein:

said mandrel is locked to said second portion of said body when at least one of said dogs has moved outwardly to sense a predetermined distance.

16. The tool of claim 7, further comprising:

a distance sensor on said second portion of said body to detect the distance to the nearest downhole tubular;

a detent on said first portion of said body selectively permitting relative movement between said first portion of said body and said second portion of said body unless a distance above a predetermined value is sensed by said sensor, whereupon said detent locks said second segment of said body to said first portion of said body, even if said anchoring device has moved out of said anchor groove.

17. The tool of claim 16, wherein:

said mandrel comprises a locking groove having a lock ring biased to move out of said locking groove;

said distance sensor comprises a plurality of movable dogs which keep said lock ring compressed in said locking groove in a first position and upon moving outwardly to sense distance having an outward travel stop which, when reached, allows said lock ring to expand partly out of said locking groove and toward said second portion of said body to lock them longitudinally.

18. The tool of claim 17, wherein:

said mandrel is locked to said second portion of said body when at least one of said dogs has moved outwardly to sense a predetermined distance.

19. The tool of claim 2, wherein:

said first setting sleeve maintains a compressive force on said first sealing member after said first detent is forced out of said first mating groove.

20. The tool of claim 19, wherein:

said detent assembly begins to drive said second setting sleeve against said second sealing member, which is in turn adjacent said first setting sleeve, as said first detent is forced from said first mating groove.

21. A downhole tool for use in a wellbore, comprising:

a body having a first and second portion;

an anchor selectively actuable and mounted to said second portion of said body;

a plurality of sealing members actuable by relative movement of said first portion with respect to said second portion;

a valve member on said body selectively actuable after said relative movement sets said sealing members in a wellbore; and a lock assembly between said first and second body portions to selectively prevent said relative movement if the distance between said second body portion and a tubular in the wellbore exceeds a predetermined value.

22. The tool of claim 21, wherein:

said first body portion further comprises a groove and a detent mounted therein;

said second body portions comprises a plurality of dogs movable outwardly to a predetermined length to sense distance to a downhole tubular;

said dogs retaining said detent in said groove to allow relative movement between said first and second body portions until a predetermined distance is detected by outward movement of said dog.

23. The tool of claim 22, wherein:

said mandrel is locked to said second portion of said body when at least one of said dogs has moved outwardly to sense a predetermined distance.

24. The tool of claim 22, wherein:

said detent is biased outwardly whereupon sufficient outward movement of said dog allows said detent to assume a straddle position partially out of said groove to prevent relative movement between said first and said second body portions.

25. The tool of claim 24, wherein:

said first body portion includes an anchor groove;

said anchor retained by a movable sleeve in a retracted position in said anchor groove;

said first and second body portions unable to move relatively until said anchor clears said anchor groove upon shifting of said movable sleeve.

26. The tool of claim 25, wherein:

said first, and second body portions are locked longitudinally despite said anchor clearing said anchor groove if said dog has moved outwardly sufficiently to allow said detent to straddle said first and second body portions.

27. The tool of claim 25, wherein:

said detent moves with said first portion of said body past said dog, when said anchor is released by moving said sliding sleeve which allows said anchor to leave said anchor groove and enter a profile in a downhole tubular.

28. A down hole tool for use in a wellbore, comprising:

a body comprising a first portion having a plurality of components and a second portion;

an anchoring device selectively actuable to support said second portion of said body downhole;

at least a first and a second sealing member actuable by relative movement of at least one of said first body portion components with respect to said second body portion when said second body portion is anchored in the wellbore by said anchoring device;

a releaseable locking member operatively connecting at least two components of said first portion of said body for tandem movement with respect to said second portion of said body to actuate said first sealing member with a predetermined force, whereupon application of said force, said locking member releases said components of said first body member to allow subsequent actuation of said second sealing member; and said locking member reengages when said first sealing member is released after it has been actuated.

29. The tool of claim 28, further comprising:

a detent assembly releasably holding at least two components of said first portion of said body against relative movement to preclude application of a actuating force to said second sealing member until after said locking member has released whereupon said detent assembly releases to permit relative movement in said components of said first body portion to actuate said second sealing member.

30. The tool of claim 29 wherein said detent assembly reengages said at least two components after release of said second sealing member subsequent to its actuation.

* * * * *